US005444927A

United States Patent [19]

Sosenko

[11] Patent Number: 5,444,927

[45] Date of Patent: Aug. 29, 1995

[54] MOTORIZED MECHANISM FOR ADJUSTING SNOW BLOWING DISCHARGE CHUTE

[76] Inventor: Paul Sosenko, 314 Cayuga St., Fulton, N.Y. 13069

[21] Appl. No.: 206,932

[22] Filed: Mar. 7, 1994

[51] Int. Cl.[6] ..... E01H 5/09

[52] U.S. Cl. ..... 37/260; 37/244; 37/261; 74/89.18; 74/435

[58] Field of Search ..... 37/244, 246, 249, 250, 37/251, 257, 260, 261; 74/89.18, 89.19, 435

[56] References Cited

U.S. PATENT DOCUMENTS

| | | | |
|---|---|---|---|
| Re. 23,771 | 1/1954 | Vanvick . | |
| 1,638,708 | 8/1927 | Saxon | 37/244 X |
| 2,092,536 | 9/1937 | Sicard | 37/251 X |
| 2,094,162 | 9/1937 | Scott | 74/435 |
| 2,916,330 | 12/1959 | Dumanowski . | |
| 2,971,279 | 2/1961 | Blanchet | 37/260 |
| 3,251,631 | 5/1966 | Hennen | 37/260 |
| 3,509,977 | 5/1970 | Bacon | 37/261 X |
| 3,510,171 | 5/1970 | Bacon | 37/260 |
| 3,580,351 | 5/1971 | Mollen | 37/257 X |
| 3,726,029 | 4/1973 | Deen et al. | 37/261 |
| 3,742,626 | 7/1973 | Ellis | 37/260 |
| 3,760,517 | 9/1973 | Blaauw | 37/260 |
| 3,780,455 | 12/1973 | Stevenson et al. | 37/261 |
| 3,808,715 | 5/1974 | Haban | 37/260 |
| 3,879,866 | 4/1975 | Gunderson | 37/260 |
| 3,886,675 | 6/1975 | Maisonneuve et al. | 37/260 X |
| 4,011,668 | 5/1977 | Gunderson | 37/260 |
| 4,158,923 | 6/1979 | Steiner et al. | 37/261 X |
| 4,205,468 | 6/1980 | Greider | 37/260 |
| 4,391,052 | 7/1983 | Guy, Jr. | 37/261 X |
| 4,409,748 | 10/1983 | Westimayer | 37/261 |
| 4,930,057 | 5/1990 | Williams | 74/89.18 X |
| 5,315,771 | 5/1994 | White, III et al. | 37/260 |

FOREIGN PATENT DOCUMENTS

| | | | |
|---|---|---|---|
| 480612 | 1/1952 | Canada | 37/261 |
| 1016965 | 9/1977 | Canada | 37/251 |
| 214923 | 3/1987 | European Pat. Off. | 37/260 |

*Primary Examiner*—Randolph A. Reese
*Assistant Examiner*—Andrea Chop
*Attorney, Agent, or Firm*—George R. McGuire

[57] ABSTRACT

An electrically powered snow blower discharge chute adjustment mechanism generally comprised of a meshingly engaging gearing arrangement wherein one of the gears is operably connected to a conventional electric motor (the drive gear), and the other gear is fixedly, circumferentially attached to the discharge chute. A three position toggle switch positioned at the operator's station of the snow blower is electrically connected to the motor for permitting the operator selective control of the direction of rotation of the discharge chute through power generated by the motor. Further, two notches are removed from opposite ends of the gear attached to the chute. The notches provide space in which the drive gear may rotatably idle when it is not meshingly engaged with the other gear. In addition, a spring loaded plunger is respectively positioned adjacent each cutout. The plungers operably engage a biasing bracket to automatically, effectively urge the two gears back into engaging relation if and when the two gears become disengaged.

16 Claims, 3 Drawing Sheets

MOTORIZED MECHANISM FOR ADJUSTING SNOW BLOWING DISCHARGE CHUTE

BACKGROUND OF THE INVENTION

FIELD OF INVENTION

The present invention generally relates to adjustable discharge chutes used on snow blowing apparatus, and more specifically to electric motor mechanisms used for adjusting the discharge chutes.

INTRODUCTION

In geographic areas where the winter months bring continuous supplies of snow, snow removal becomes a high priority to most individuals. Traditionally, home owners used only shovels to keep driveways and walkways clear. But manually shoveling snow is a time consuming, laborious task. Therefore, as technology advanced, in order to reduce the amount of time and effort needed to remove snow, power operated snow blowing apparatus, or snow blowers as they are termed in the art, were introduced.

Snow blowing apparatus vary in size and snow removing capability, but essentially all snow blowers operate in the same manner. Some sort of snow scooping device is positioned in a snow gathering housing at the front of a two-wheel or four-wheel chassis to continuously lift snow off the ground and transfer it to a chute where a fan, vacuum source, or similar air agitating device, is positioned to blow the snow through the chute and in a predetermined trajectory, preferably causing the snow to land at a location where it can be left to eventually melt.

Of course, since the shape of areas to be cleared of snow vary from site to site, it is necessary to permit the discharge chute of a snow blower to be adjustable. Many different gearing mechanisms that permit adjustment of the discharge chutes of snow blowers are revealed in the prior art.

U.S. Pat. No. Re 23,771 to Vanvick discloses a pair of circular, meshing gears, one attached to the discharge chute and the other to a user controlled rod. Upon manual rotation of the rod rotation of the discharge chute about a vertical axis is produced.

U.S. Pat. No. 3,760,517 to Blaauw uses the same operating principles as the '771 patent discussed above except for substituting a worm gear and worm spring combination in place of the meshing gears.

U.S. Pat. Nos. 2,916,330 to Dumanowski; 4,011,668 to Gunderson; 3,510,171 to Bacon; 3,251,631 to Hennen; 2,971,279 to Blanchet; and 3,879,866 to Gunderson further exemplify the prior art. Each of these patents disclose systems having operating principles analogous to the '771 and '517 patents previously discussed.

Since snow blowing apparatus is principally used during the winter when temperatures are generally below freezing, the adjustment mechanisms of the above disclosed prior art tend to freeze and accumulate large quantities of snow and ice which may jam the mechanisms, thereby requiring much maintenance due to their mechanical linkages. The manual act of having to move the control rods to produce rotation of the discharge chute also becomes troublesome in the cold weather due to the stiffness and brittleness of the linkage's material composition.

Furthermore, if the two gear mechanisms disclosed in each of the pertinent references become disengaged from one another, it is necessary for the operator to manually adjust the gears back into meshing engagement.

OBJECTS AND ADVANTAGES

It is therefore a principal object of the present invention to provide a snow blower discharge chute which may be adjusted through electrically actuated means.

It is a further object of the instant invention to provide a discharge chute adjustment mechanism having means for automatically re-engaging the two meshing gears if they become disengaged.

It is another object of the present invention to provide a discharge chute adjustment mechanism having means for limiting the adjustability of the chute to 210 degrees, thereby preventing the chute from ever discharging snow in the direction of the machine operator.

It is yet another object of the present invention to provide a discharge chute adjustment mechanism having means for preventing accumulation of snow, ice, and other foreign particles in the gearing mechanism.

Other objects will in part be obvious and in part appear hereinafter.

SUMMARY OF THE INVENTION

In accordance with the foregoing objects and advantages, the present invention provides an electrically powered snow blower discharge chute adjustment mechanism. Although in its preferred form the invention is practiced on a snow blower having a four wheel chassis supporting it (i.e., a tractor), the present invention could certainly be practiced on a conventional two wheeled snow blower.

The adjustment mechanism is generally comprised of a partially circular, steering gear fixedly positioned about the base of the vertically extending discharge chute; a smaller, circular, drive gear (or sprocket wheel) positioned in meshing engagement with the steering gear; and an electric motor rotatably attached to the drive gear. Upon user actuation, the motor generates rotation of the drive gear and the ultimate rotation of the discharge chute about its vertical axis. Motor controls consisting of a three position toggle switch is positioned at the operator's station of the snow blower for permitting user selective control of the direction of rotation of the discharge chute.

The steering gear has teeth extending about 180 degrees around its non-terminal periphery and further includes arcuate notches positioned at either ends of the teeth. The arcuate notches prevent rotation of the discharge chute past the two terminal positions of the steering gear by providing a clearance in which the drive gear may rotatably idle while not engaging any portion of the steering gear. In addition, in case the two gears become disengaged, first and second spring loaded plungers are respectively positioned on the steering gear adjacent the two notches, in compressively operative relation with a stepped biasing support to urge the teeth of the two gears to become re-engaged, thereby eliminating the need for the operator to leave the operator's station and manually adjust the gears back into engaging relation with one another.

The electric motor is mounted on a bracket attached to the snow gathering housing and is attached to a power source, such as the battery which powers the snow blower. The motor produces rotational output to a shaft which is fixedly, centrally attached to the center of the drive gear. Wires extending from the motor to the three position toggle switch located at the operator's station permit selective control of the direction of rotation produced by the motor. If the toggle switch is positioned in its left-most position, the motor will produce counter-clockwise rotation, and if the toggle switch is in its right-most position the motor will produce clockwise rotation. Once the trajectory of the chute reaches its desired position, the toggle switch may be positioned in its middle (or neutral) position, thereby eliminating any rotational output from the motor.

The bracket to which the motor is attached is angled in such a way so as to act as a covering to the drive gear and further to the engaging junction of the two meshing gears. This covering prevents any snow or ice from accumulating in the teeth of the gears, thereby substantially preventing the gearing mechanism from jamming due to the accumulation of foreign particles.

DETAILED DESCRIPTION

Figure 1:
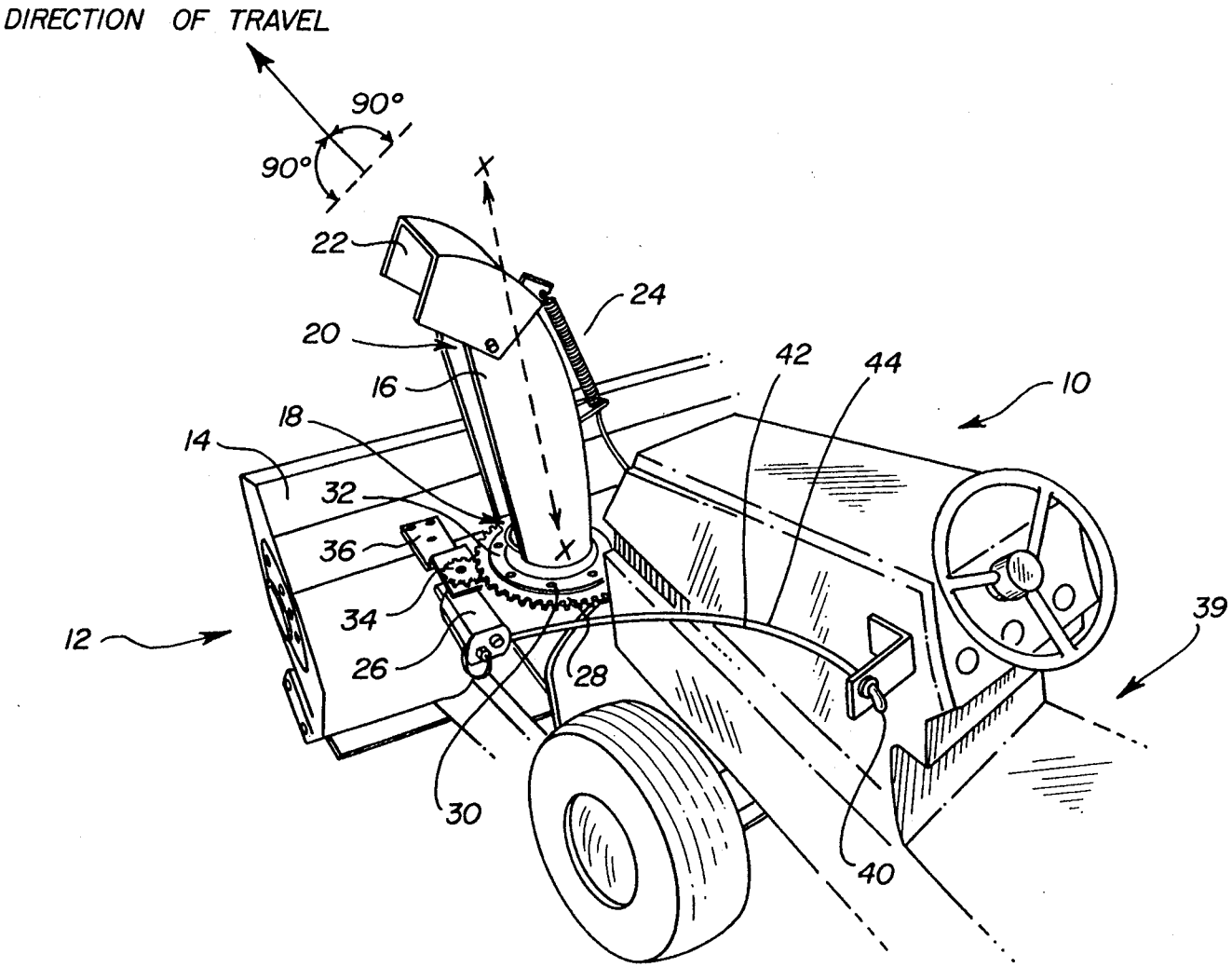
FIG. 1 is a perspective view showing the present invention, including the toggle switch, employed on a snow blower mounted at the front end of a four-wheeled chassis.

Referring now to the drawings wherein like reference numerals refer to like parts throughout, there is seen in FIG. 1 a tractor, denoted generally by reference numeral 10, having a conventional snow blowing apparatus 12 mounted to the front end thereof. Although shown in its preferred form as being mounted to tractor 10, snow blower 12 could easily be mounted to a two-wheeled chassis.

Snow blower 12 includes a snow gathering housing 14 which directs snow into a vertically oriented, adjustable snow discharge chute 16. Discharge chute 16 is rotatably adjustable about a vertical axis X—X and includes a snow inlet end 18 and snow outlet end 20. A snow deflector 22 is pivotally attached to chute 16 adjacent outlet end 20 for permitting control of the trajectory of the discharged snow via mechanical control linkage 24.

Discharge chute 16 is rotatably adjustable about axis X—X by means of an electrically actuated motor 26 and a gearing arrangement. The gearing arrangement is comprised of a partially circular, steering gear 28 spanning a circumference of approximately 210 degrees fixedly attached to discharge chute 16 annularly adjacent inlet end 18 by bolts 30 (or any equivalent mounting means) passing through flanged portion 32 of discharge chute 16; and a circular, sprocket, drive gear 34 rotatably, operatively connected to motor 26 and primarily positioned in meshing engagement with gear 28.

Figure 2:
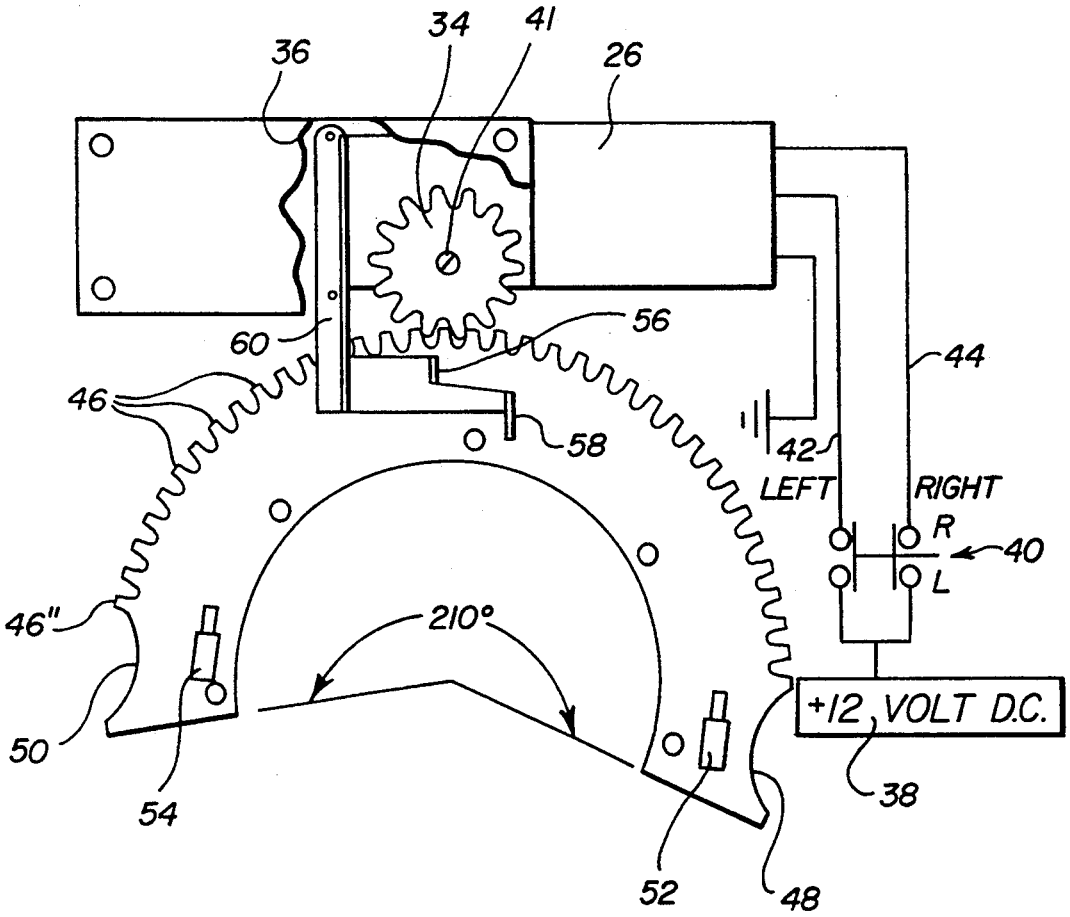
FIG. 2 is a top plan view of the gearing arrangement used to produce rotations of a snow blowing discharge chute, with the power source of the motor shown schematically.
Figure 3:
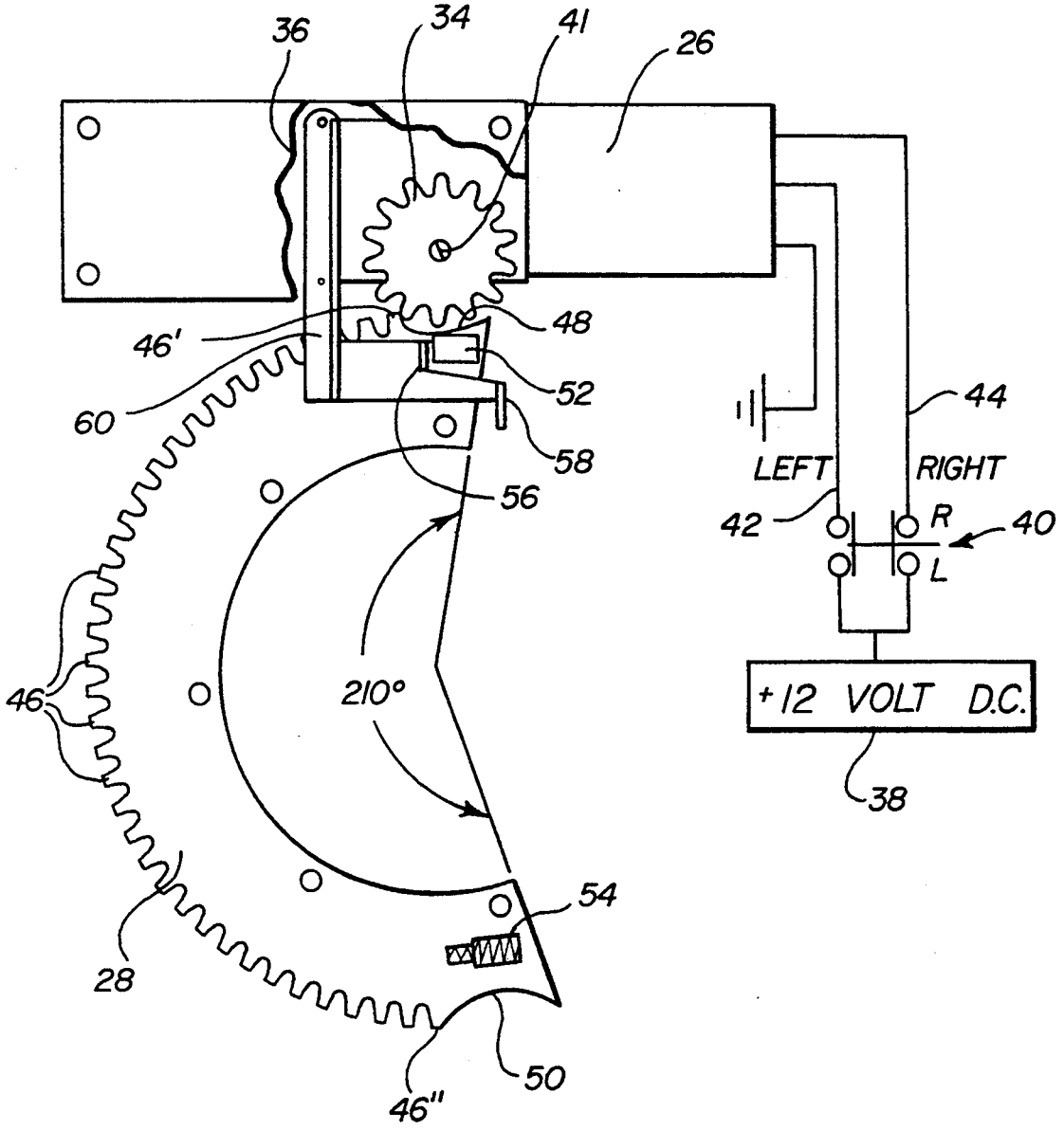
FIG. 3 is a top plan view of the gearing arrangement showing the gear attached to the chute in one of its terminal positions and a plunger being fully compressed by the biasing support.

Motor 26 is attached to snow gathering housing 14 by an angled bracket 36 shown partially cut away in FIG. 1, and is powered by any conventional power source, such as a 12 volt battery 38 as is shown schematically in FIGS. 2 and 3. Motor 26 further is electrically connected to a 3-position toggle switch 40 which is positioned at the operator's station, denoted generally by reference numeral 39, via wires 42 and 44. Motor 26 operates in a conventional manner generating rotational output to a driveshaft 41 which fixedly extends through the center of gear 34 in response to electrical actuation. Thus, when power is supplied to motor 26, gear 34 rotates in a corresponding clockwise or counter-clockwise direction.

Toggle switch 40 permits the operator to control the direction of rotation of discharge chute 16. By positioning switch 40 in its left-most position, motor 26 rotates in a counter-clockwise direction, or positioning it in its right-most position motor 26 rotates in a clockwise direction. When chute 16 is in a desired position, switch 40 may be moved to its middle position, thereby leaving chute 16 stationary.

Angled bracket 36 is formed in such a way so as to be positioned in covering relation to drive gear 34 and the engaging junction of meshing gears 28 and 34. This covering relation prevents any snow, ice, or other foreign particles from accumulating, thereby effectively preventing the gearing arrangement from becoming jammed due to the accumulation of foreign particles.

Steering gear 28 includes teeth 46 continuously formed around approximately 180 degrees of its non-terminal periphery. The two end teeth are denoted by reference numerals 46' and 46''. Arcuate notches 48 and 50 are respectively formed in the approximately 15 degrees remaining on the terminal ends of gear 28 adjacent end teeth 46' 46''. The 180 degrees of teeth 46 permit chute 16 to be rotatably adjustable approximately 90 degrees in either direction from the direction tractor 10 is traveling as is indicated in FIG. 1. If gear 34 continues traveling beyond one of end teeth 46' 46'', notches 48 and 50 are large enough to permit drive gear 34 to rotatably idle in the space provided, thereby not engaging any portion of gear 28, as is shown in FIG. 3. Furthermore, notches 48 and 50 effectively prevent chute 16 from traveling beyond either of its terminal ends.

If and when gear 34 becomes disengaged from gear 28 and positioned in either notch 48 or 50, spring loaded plungers 52 and 54, respectively positioned adjacent notches 48 and 50, respectively engage an appropriately positioned stepped portion 56 and 58 of a biasing bracket 60 which acts as a stop to plungers 52 and 54. Plunger 52 engages step 56 when gear 28 is rotating in a counter-clockwise direction and plunger 54 engages step 58 when gear 28 is rotating in a clockwise direction. Bracket 60 extends outwardly from bracket 36 with stepped portions 56 and 58 being positioned forwardly adjacent gear 34. As seen in FIG. 3, plunger 52 becomes compressed against step 56 when gear 34 becomes disengaged from gear 28, thereby urging gear 28 to counter-rotate and become reengaged with gear 34, and further, eliminating the need for the operator of tractor 10 to leave the operator's station and manually reengage the two gears. Of course, the same situation exists when gear 28 is over rotated in a clockwise direction and plunger 54 urges against step 58.

What is claimed is:

1. A snow blowing apparatus having a wheeled chassis, said chassis having a front end and an operator's station positioned rearwardly of said front end, said snow blowing apparatus comprising:

a) a snow gathering housing mounted to said front end of said chassis;

b) a snow discharge chute extending essentially vertically upward from said snow gathering housing, said chute having an inlet end rotatably mounted to said snow gathering housing and an opposite, open outlet end, and further having an essentially vertically extending axis about which said chute is rotatable;

c) first gear means fixedly attached to said discharge chute adjacent said inlet end thereof and in concentric relation to said essentially vertically extending axis said first gear means including a plurality of teeth extending in circumferentially spaced relation between first and second terminal ends said first and second terminal ends define first and second end teeth respectively, and being rotatable between terminal clockwise and terminal counter-clockwise positions;

d) second gear means positioned in meshing engagement with said first gear means;

e) means for automatically idling said second gear means upon said first gear means being positioned in one of said terminal clockwise and counter-clockwise positions said idling means including first and second notches formed in said first gear means adjacent said first and second end teeth, respectively;

f) means biasing said first gear means in clockwise and counter-clockwise directions upon reaching said terminal counter-clockwise and clockwise positions, respectively, said biasing means including:

i) first and second spring loaded plungers fixedly attached to said first gear means adjacent said first and second notches, respectively; and ii) first and second stop means positioned for compressing said first and second plungers upon said first gear means reaching said terminal clockwise and terminal counter-clockwise positions, respectively;

g) motor means connected to said second gear means, said motor means being selectively actuable to rotate said second gear means in alternating clockwise and counter-clockwise directions; and h) switch means electrically connected to said motor means, said switch means selectively, manually operable to cause said motor means to rotate said second gear means in either of said clockwise and counter-clockwise directions, thereby rotating said first gear means and said chute in counter-clockwise and clockwise directions, respectively.

2. The invention according to claim 1 further including power supply means electrically connected to said motor means.

3. The invention according to claim 2 wherein said power supply means is a 12-volt battery.

4. The invention according to claim 1 and further including means for selectively adjusting the trajectory of snow exiting said outlet end of said chute.

5. The invention according to claim 4 wherein said trajectory adjustment means includes a snow deflector pivotally attached to said discharge chute adjacent said outlet end.

6. The invention according to claim 1 further including a housing positioned in at least partially covering relation to said first and second gear means for preventing foreign particles from accumulating within said first and second gear means.

7. A snow blowing apparatus having a wheeled chassis, said chassis having a front end and an operator's station positioned rearwardly of said front end, said snow blowing apparatus comprising:

a) a snow gathering housing mounted to said front end of said chassis;

b) a snow discharge chute extending essentially vertically upward from said snow gathering housing, said chute having an inlet end rotatably mounted to said snow gathering housing and an opposite, open outlet end, and further having an essentially vertically extending axis about which said chute is rotatable;

c) first gear means fixedly attached to said discharge chute annularly adjacent said inlet end, said first gear means including a plurality of teeth extending thereon in circumferentially spaced relation between first and second terminal ends and further being rotatable between terminal clockwise and terminal counter-clockwise positions;

d) second gear means positioned in meshing engagement with said first gear means;

e) motor means connected to said second gear means, said motor means being selectively actuable to rotate said second gear means in alternating clockwise and counter-clockwise directions;

f) means for automatically idling said second gear means upon said first gear means being positioned in one of said terminal clockwise and terminal counter-clockwise positions, said idling means including first and second notches formed in said first gear means adjacent said first and second terminal ends, respectively; and g) means biasing said first gear means in said clockwise and said counter-clockwise directions upon reaching said terminal counter-clockwise and clockwise positions, respectively, said biasing means including:

i) first and second spring loaded plungers fixedly attached to said first gear means adjacent said first and second notches, respectively; and ii) first and second stop means positioned for compressing said first and second plungers upon said first gear means reaching said terminal clockwise and terminal counter-clockwise positions, respectively.

8. The invention according to claim 7 and further including means for selectively adjusting the trajectory of snow exiting said outlet end of said chute.

9. The invention according to claim 8 wherein said trajectory adjustment means includes a snow deflector pivotally attached to said discharge chute adjacent said snow outlet end.

10. The invention according to claim 7 further including a housing positioned in at least partially covering relation to said first and second gear means for preventing foreign particles from accumulating within said first and second gear means.

11. A snow blowing apparatus having a wheeled chassis, said chassis having a front end and an operator's station positioned rearwardly of said front end, said snow blowing apparatus comprising:

a) a snow gathering housing mounted to said front end of said chassis;

b) a snow discharge chute extending essentially vertically upward from said snow gathering housing, said chute having an inlet end rotatably mounted to said snow gathering housing and an opposite, open outlet end, and further having an essentially vertically extending axis about which said chute is rotatable;

c) first gear means fixedly attached to said discharge chute adjacent said inlet end thereof and in concentric relation to said essentially vertically extending axis, said first gear means being rotatable between terminal clockwise and terminal counter-clockwise positions;

d) second gear means positioned in meshing engagement with said first gear means;

e) motor means connected to said second gear means, said motor means being selectively actuable to rotate said second gear means in alternating clockwise and counter-clockwise directions, thereby rotating said first gear means and said chute in counter-clockwise and clockwise directions, respectively;

f) said first gear means includes i) a plurality of teeth extending in circumferentially spaced relation between first and second end teeth; and ii) first and second notches formed in said first gear means adjacent said first and second end teeth, respectively; and g) means biasing said first gear means in said clockwise and counter-clockwise directions upon said first gear means being positioned in said terminal counter-clockwise and clockwise directions, respectively, said biasing means including:

i) first and second spring loaded plungers fixedly attached to said first gear means adjacent said first and second notches, respectively; and ii) first and second stop means positioned for compressing said first and second plungers upon said first gear means reaching said terminal clockwise and terminal counter-clockwise positions, respectively.

12. The invention according to claim 11 further including power supply means electrically connected to said motor means.

13. The invention according to claim 12 wherein said power supply means is a 12-volt battery.

14. The invention according to claim 11 and further including means for selectively adjusting the trajectory of snow exiting said outlet end of said chute.

15. The invention according to claim 14 wherein said trajectory adjustment means includes a snow deflector pivotally attached to said discharge chute adjacent said outlet end.

16. The invention according to claim 11 further including a housing positioned in at least partially covering relation to said first and second gear means for preventing foreign particles from accumulating within said first and second gear means.

* * * * *